US005160072A

United States Patent [19]

Nye

[11] Patent Number: 5,160,072

[45] Date of Patent: Nov. 3, 1992

[54] CONTAINER VALVE HAVING A WEIGHTED ACTUATOR

[76] Inventor: Norman H. Nye, 1348 High Bridge Rd., Cuyahoga Falls, Ohio 44223

[21] Appl. No.: 739,827

[22] Filed: Aug. 2, 1991

[51] Int. Cl.[5] ..... B67D 5/64

[52] U.S. Cl. ..... 222/463; 222/500; 222/509

[58] Field of Search ..... 222/500, 505, 509, 518, 222/559, 563, 463; 137/38

[56] References Cited

U.S. PATENT DOCUMENTS

| | | | |
|---|---|---|---|
| 330,812 | 11/1885 | Ward | 222/500 |
| 420,320 | 1/1890 | Wagner | 222/500 |
| 1,664,068 | 3/1928 | Fisher | 222/500 X |
| 2,409,118 | 10/1946 | Fleak | 222/500 X |
| 2,427,380 | 9/1947 | Benoit | 222/500 X |
| 2,656,076 | 10/1953 | Von Essen | 222/500 X |
| 3,228,569 | 1/1966 | Jaccard | 222/463 X |
| 3,229,856 | 1/1966 | Jungmann | 222/500 X |

*Primary Examiner*—Kevin P. Shaver
*Assistant Examiner*—Kenneth DeRosa
*Attorney, Agent, or Firm*—Oldham, Oldham & Wilson Co.

[57] ABSTRACT

A valve for a fluid pressurized dispensing container that is useful for the low pressure dispensing of medium and low viscosity fluids at controlled rates and is actuated by merely inverting the container and in which the flow of the dispensed liquid begins practically instantly as soon as the container is inverted.

5 Claims, 1 Drawing Sheet

CONTAINER VALVE HAVING A WEIGHTED ACTUATOR

FIELD OF THE INVENTION

This invention concerns a valve for use with low pressure dispensing containers. It is particularly designed for the use with the type of self pressurized containers in which the pressure for dispensing is provided for by means of an elastic sleeve that surrounds a pleated liner pouch, such a type of container is described in U.S. Pat. No. 4,423,829 issued to Hyman Katz and U.S. Pat. No. 4,121,737 issued to Clavin L. Kain. However, the valve described here may be used in conjunction with containers that are pressurized by other means.

BACKGROUND ART

The most common types of containers that are used for the pressure dispensing of fluids are of three types as follows:

1. The aerosol containers in which the pressure is provided for by means of a fluid that is liquid when under pressure and becomes a gas when the pressure is reduced.
2. Plastic containers, made of flexible material, that are pressurized when squeezed.
3. Containers for which the pressure for dispensing is provided by a pump.

All of the above types of containers have certain disadvantages.

The aerosol types of containers are pressurized by gases that are environmentally and fire hazardous, also the pressure must be high enough that the pressurizing medium will be kept in a liquid state while in the container and therefor when the dispensed material comes out of the container nozzle it either sprays or is squirted.

The squeeze type of container has the disadvantage that when it is partly empty and is inverted for dispensing and the material to be dispensed is somewhat viscous, it is necessary to wait for the material to flow by gravity down to the nozzle and for instance if the material is catsup or mustard the wait can be irritatingly slow and sometimes if the timing of the squeeze is not right a spattering occurs as air becomes trapped in the material.

Pumping containers have many small parts and are expensive to manufacture.

Many of the valves that are in service at present have small passageways between the valve seat and the atmosphere and these passageways retain material that can dry out or congeal and perhaps become contaminated with dirt or bacteria.

Most of the valves presently being used require some muscular effort to operate them and this may cause some problems for elderly people who are weak or for people that have arthritic problems in their hands.

DISCLOSURE OF THE INVENTION

This invention provides a valve for dispensing that is as easy as pouring out of a bottle. It dispenses liquids at a predetermined rate no matter how it is handled and this feature may be important especially in the medical field. No muscular strength is required except enough to invert the container. The flow is always instantaneous as soon as the container is inverted. The valve is very simple and inexpensive to manufacture. There is no place for a residue of material to be retained and exposed to the atmosphere. And there is a provision for a cap that when it is in place it prevents leakage no matter how rough the container is handled.

DETAILED DESCRIPTION

Figure 1:
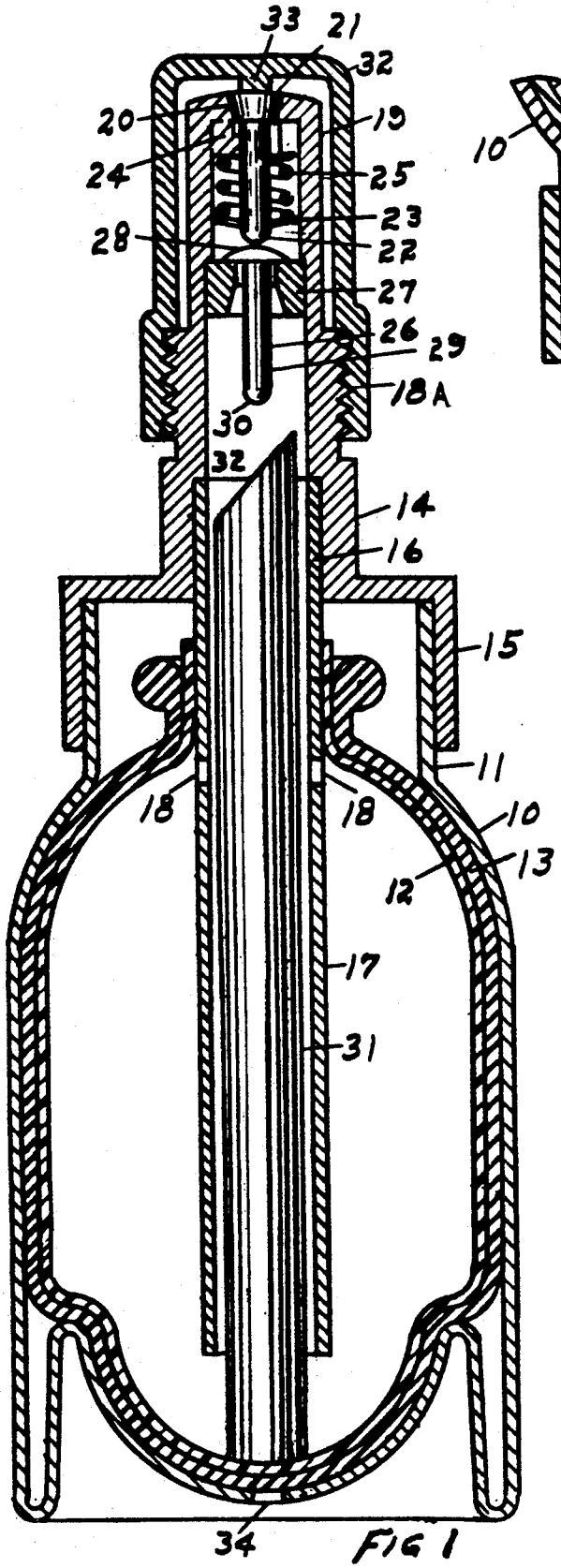
FIG. 1 is a Cross-Sectional view of a container shown filled with a material and in an upright position with the valve in a closed position.

Refer to FIG. 1. a cylindrical shell 10 having at its top a central opening surrounded by a neck 11 is the outer component of a container. A liner 12 (also open at the top) is an inner component and it is a cylindrical pouch for containing the liquid that is to be dispensed. The liner 12 when initially made is of a smaller diameter than is shown in this figure and is similar to the inner liner shown in U.S. Pat. No. 4,423,829 that was issued to Hyman Katz. Surrounding the liner 12 is an elastic elastomeric sleeve 13 (also open at the top) that is usually made of rubber and the sleeve 13 serves as a pressure producing member as it normally has a small diameter and is expanded and stretched radially when the pouch 12 is filled with a liquid and its tendency to resume its initial diameter results in pressure on the liquid in the container.

A discharge valve is mounted above the central opening of the container for controlling the discharge of the pressurized liquid. This discharge valve includes a valve body 14 that is cylindrical in shape and has a lower annular body portion 15 and an internal machined diameter 16 to which is tightly fitted Tube 17 that is long enough to reach nearly to the bottom of the liner 12. The valve body 14 has a threaded portion 18A and a nozzle portion 19. Lower body portion 15 fits over neck 11 so that the valve is supported above the container. Holes 18 are provided through the wall of tube 17 near the top so as to allow the flow of liquid that may be trapped near the top of the liner 12 when the liner 12 is nearly empty. A valve seat 20 having the shape of a frustum is located at the outermost end of the nozzle portion 19. A valve closure member 21 that has a frustum shape that corresponds and fits valve seat 20 is located so that its upper surface is flush with the outermost end of the nozzle portion 19 the larger ends of the frusta of the valve seat 20 and the valve closure member 21 are each at the outermost end of the nozzle portion 19 so that the valve closure member 21 opens by axial reciprocal movement outwardly, that is away from the valve body 14 and the container. This outward movement is downward when the container is inverted as shown in FIG. 2.

Figure 3:
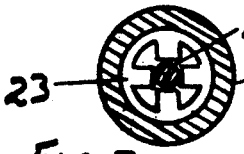
FIG. 3 is a Cross-Sectional view taken on line 3—3 of FIG. 2.
Figure 4:
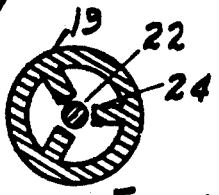
FIG. 4 is a Cross-Sectional view taken on line 4—4 of FIG. 2.

Integral and attached to valve closure member 21 is a short rounded valve stem 22 which extends axially inwardly from the valve closure member 21 and to which is applied an internally pronged ring washer 23. This ring washer 23 is a readily obtainable catalog item and is illustrated in FIG. 3. It can be pushed onto valve stem 22 but because of the angle of the internal prongs it digs in and resists coming off. The ring washer 23 fits closely but is slidable on the inside diameter of the nozzle 19 and serves to maintain the lower end of the valve stem 22 central with the axis of the nozzle portion 19. Vanes 24 as illustrated in FIG. 4 are provided to maintain the frustum part of valve member 21 central in the valve opening 20 when the valve member 21 is in an open position as shown in FIG. 2.

A spring 25 provides force to normally hold the valve member 21 tightly against the valve seat 20 as shown in FIG. 1. Below the rounded end of the valve stem 22 is a fixedly mounted bushing 27 which supports a tack shaped member 26 having a convex head 28 and a shank 29 extending axially therefrom and having a rounded tip end 30. There is normally a small clearance between the top convex head 28 of the tack shaped member and the lower rounded end 30 of the valve stem 24 when the valve is closed. Inside the tube 17 is a very loosely fitted axially reciprocable rod 31 the purpose of which is to act as a weight to produce a force to actuate the valve when the container is inverted.

Figure 2:
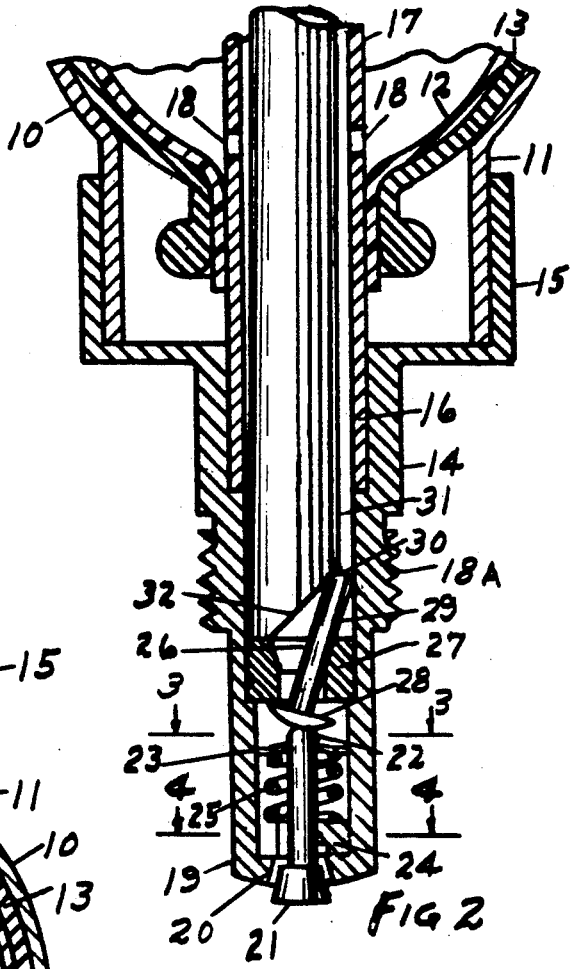
FIG. 2 is an enlarged Cross-Section of the valve that is inverted and is in a discharge condition.
Figure 5:
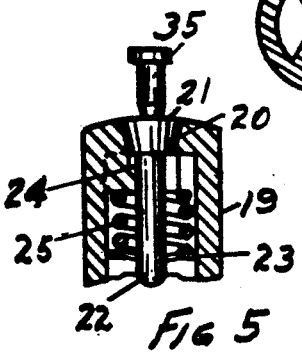
FIG. 5 shows an appendage that is temporarily attached for the purpose of holding the valve open when filling the container.

Now refer to FIG. 2 that shows an inverted cross-section of the valve mechanism as it will be after the container is inverted and the contents of the container are being discharged. The purpose of the tack shaped member 26 is for it to act as a lever to multiply the force of the weight of the rod 31 so as to overcome the strength of the spring 25 and open the valve. In this design the pressure of the liquid tends to open the valve. The spring 25 is designed to be srong enough to oppose the liquid pressure on the valve member 21 and keep the valve closed and leak proof when the container is normally in the vertical position and also if it may be laying in a horizontal position. When the container is inverted the rod 31 falls by gravity so that its beveled end 32 contacts the rounded tip 30 of the tack shaped member 26. A portion of the head 28 of tack shaped member 26 contacts the bushing 27 at a fulcrum point and pivots about this fulcrum point. Another portion of the head 28 contacts the valve stem 22 moving the valve stem 22 and the valve closure member 21 axially (downwardly as shown in FIG. 2) to the valve open position. Thus the tack shaped member (or lever)26 engages the valve closure member 21 through the valve stem 22 and also engages the rod 31 when the container is inverted. In this way the weight of the rod 31 is multiplied several times by the leverage effect of the tack shaped member 26 plus the pressure of the contents of the liquid content of the container will produce enough force to open the valve. A clear space between the beveled end 32 of the rod 31 and the rounded end 30 of the tack shaped member 26 allows rod 31 to strike the tack shaped member 26 and through it force the valve member 21 to move in case it sticks. A threaded cap 32 is provided for the protection of the nozzle portion 19 and the valve member 21 and inside the cap 32 is a projection 33 that contacts the valve member 21 and holds the valve closed to prevent leakage and damage when the container is roughly handled. The container can be filled through the valve with liquid when it is inverted but for speedily filling it may be desirable to mechanically hold the valve open and for this purpose a hole 34 is provided in the bottom of the shell 10 through which a prong can be inserted to press against the end of rod 31 to hold the valve open or the valve member 21 may be provided with a temporary appendage 35 as shown on FIG. 5 that is attached to the valve member 21 that can be grasped to hold the valve open and that can be broken off or cut off after the container has been filled.

The design described here shows the invention as it is adapted for use with one particular kind of container. The principles of this invention may be applied for use with other kinds of pressurized containers.

I claim:

1. A valve for a pressurized fluid dispensing container, said valve comprising:

(a) a valve body having a discharge nozzle portion, said nozzle portion including a valve seat and a valve closure member therefor, said valve closure member opening by outward axial movement, and means for biasing said valve closure member to closed position, so that said valve closure member is normally held tightly against the valve seat to prevent leakage or discharge of the contents of said container;

(b) a valve stem attached to said valve closure member and extending axially inwardly therefrom;

(c) a shiftable weight inside said container, said weight being an axially reciprocal rod, said weight not affecting said valve closure member when said container is upright or horizontal but operative to open said valve closure member when said container is inverted; and (d) a lever interposed between said valve closure member and said weight, said lever contacting said rod and said valve stem when said container is inverted so as to open said valve closure member.

2. A valve according to claim 1 further including a protective cap that will contact the valve closure member and hold it tightly against the valve seat to prevent leakage or discharge of the contents of said container when said cap is in place.

3. A valve according to claim 1 further including an appendage that can be grasped to hold said valve member in an open position when said container is being filled and that can be broken off or cut off after said container has been filled.

4. A valve according to claim 1 wherein said valve closure member and said valve seat are each frustum shaped, with the largest end of the frustum being at the outermost end of said nozzle.

5. A valve according to claim 1 further including a fixedly mounted fulcrum for said lever and wherein said lever is in the form of a tack shaped member having a head and a shank, and said rod has a beveled surface at its upper end, a portion of the head of said tack shaped member pivoting about said fulcrum and another portion of said head contacting said valve stem, said shank having a tip which contacts said beveled surface of said rod when said container is inverted.

* * * * *